US007581497B2

(12) United States Patent
Rabin et al.

(10) Patent No.: US 7,581,497 B2
(45) Date of Patent: Sep. 1, 2009

(54) SELF-CONTAINED, NON-INTRUSIVE DATA ACQUISITION IN AMMUNITION

(75) Inventors: Daniel A. Rabin, Glen Allen, VA (US); Traver J. Sutton, King George, VA (US); Michael J. Bottass, King George, VA (US); Douglas A. Hopkins, King George, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 583 days.

(21) Appl. No.: 11/250,690

(22) Filed: Sep. 21, 2005

(65) Prior Publication Data

US 2007/0067138 A1 Mar. 22, 2007

(51) Int. Cl.
*F42B 35/00* (2006.01)

(52) U.S. Cl. ..... 102/293; 102/529; 89/6.5

(58) Field of Classification Search ..... 102/293, 102/215, 529; 89/41.03, 6.5; 702/150
See application file for complete search history.

(56) References Cited

U.S. PATENT DOCUMENTS

| | | | | |
|---|---|---|---|---|
| 2,105,528 | A * | 1/1938 | Foisy | 102/529 |
| 3,814,017 | A * | 6/1974 | Backstein et al. | 102/215 |
| 4,686,885 | A * | 8/1987 | Bai | 89/6.5 |
| 4,711,152 | A * | 12/1987 | Fortunko | 89/6.5 |
| 5,078,051 | A * | 1/1992 | Amundson | 102/206 |
| 5,275,108 | A * | 1/1994 | Chernicky et al. | 102/439 |
| 5,659,148 | A | 8/1997 | Isgen | 89/14.05 |
| 6,085,629 | A * | 7/2000 | Thiesen et al. | 89/6.5 |
| 6,189,430 | B1 * | 2/2001 | Vornfett | 89/6.5 |
| 6,202,532 | B1 | 3/2001 | Kadushin | 89/6.5 |
| 6,378,437 | B1 | 4/2002 | Burke, Jr. et al. | 102/293 |
| 6,810,816 | B2 * | 11/2004 | Rennard | 102/430 |
| 6,823,767 | B2 * | 11/2004 | Vornfett et al. | 89/6.5 |
| 7,193,556 | B1 * | 3/2007 | Pereira et al. | 342/62 |
| 2003/0058130 | A1 * | 3/2003 | Kramer et al. | 340/870.07 |
| 2003/0136250 | A1 * | 7/2003 | Vornfett et al. | 89/6.5 |
| 2007/0001051 | A1 * | 1/2007 | Rastegar et al. | 244/3.1 |

* cited by examiner

*Primary Examiner*—Michael Carone
*Assistant Examiner*—Benjamin P Lee
(74) *Attorney, Agent, or Firm*—Gerhard W. Thielman, Esq.

(57) ABSTRACT

Various implementations are disclosed for self-contained, non-intrusive data collection in ammunition. In some implementations, a gun is loaded with a non-explosive, non-firing round of ammunition containing a data acquisition system. Such a data-collecting round of ammunition may be loaded into the gun according to the same procedures as live rounds of ammunition, and, in particular, may be loaded into a firing position immediately after a preceding live round has been fired. In this way, the data-collecting round of ammunition is able to experience temperature or other conditions that are experienced essentially identically by live rounds. After collecting related data while in the firing position, the data-collecting round may be removed from the gun, for analysis of the data for, for example, development of hot gun misfire safety procedures.

10 Claims, 6 Drawing Sheets

SELF-CONTAINED, NON-INTRUSIVE DATA ACQUISITION IN AMMUNITION

STATEMENT OF GOVERNMENT RIGHTS

This invention was made with government support funded under the United States Navy Program Executive Office (PEO) for Integrated Warfare Systems (IWS) 3C, in support of the United States Coast Guard (USCG) Deepwater program. The government has certain rights in the invention.

TECHNICAL FIELD

This description relates to data acquisition in ammunition.

BACKGROUND

It is a priority during operation and use of guns and other ammunition launchers to maintain a safe environment for the operators of such devices, other personnel who may be in the vicinity of the devices, as well as the equipment both comprising and surrounding the device. However, human error, malfunction of one or more of the components in use, or an unfavorable change in current operating conditions may nonetheless lead to personnel injury and/or damage to the weapon being used.

In order to avoid such injuries and equipment damage, safe operating procedures are typically designed for particular weapons systems or types of weapons systems, and are in place for use by operating personnel. For example, procedures may be in place that define how ammunition is loaded, when ammunition is loaded, and what to do in case personnel error, malfunction of the weapons system, or undesirable conditions do occur.

One example of a potential problem relates to the operating temperature of the related weapons system and/or ammunition. For example, if prolonged firing of a weapon raises the temperature of certain components of the weapon to a certain extent, thus causing heat to soak into a piece of ammunition, the ammunition may have an unexpected or abnormal reaction. Other examples exist as to how mishandling, malfunction, or prolonged usage of a given weapons system may lead to personnel injury and/or damage to the weapons system.

SUMMARY

According to one implementation, a data-collecting round of ammunition is loaded into a firing position within a weapons system, the data-collecting round containing a data acquisition system. A stoppage of a firing procedure of the weapons system is initiated (either accidentally or manually instructed), while the data-collecting round is in the firing position. Data is collected related to the components of the data-collecting round while in the firing position.

According to another implementation, a system for collecting data includes a round including a cartridge case (herein referred to also as "case") and a projectile body (herein referred to also as "body") having a shape that is compatible with placement within a firing position of a weapons system, a data acquisition system within the case, and a plurality of sensors disposed within or on the round (including, in some implementations, within or on either the case and/or the body) and in communication with the data acquisition system to provide data relating to the components of the data-collecting round while the data-collecting round is in the firing position, for storage thereof within the data acquisition system.

In another implementation, a loading procedure is implemented for loading rounds of ammunition from a magazine into a weapons system, the magazine including a plurality of live rounds of ammunition and a data-collecting round of ammunition. The live rounds of ammunition are fired from the weapons system in sequence, until the data-collecting round is reached. The data-collecting round is loaded into a firing position of the weapons system according to the loading procedure after a firing of a preceding live round of ammunition from the plurality of live rounds of ammunition, and data is collected related to the components of the data-collecting round of ammunition while in the firing position.

DETAILED DESCRIPTION

Figure 1A:
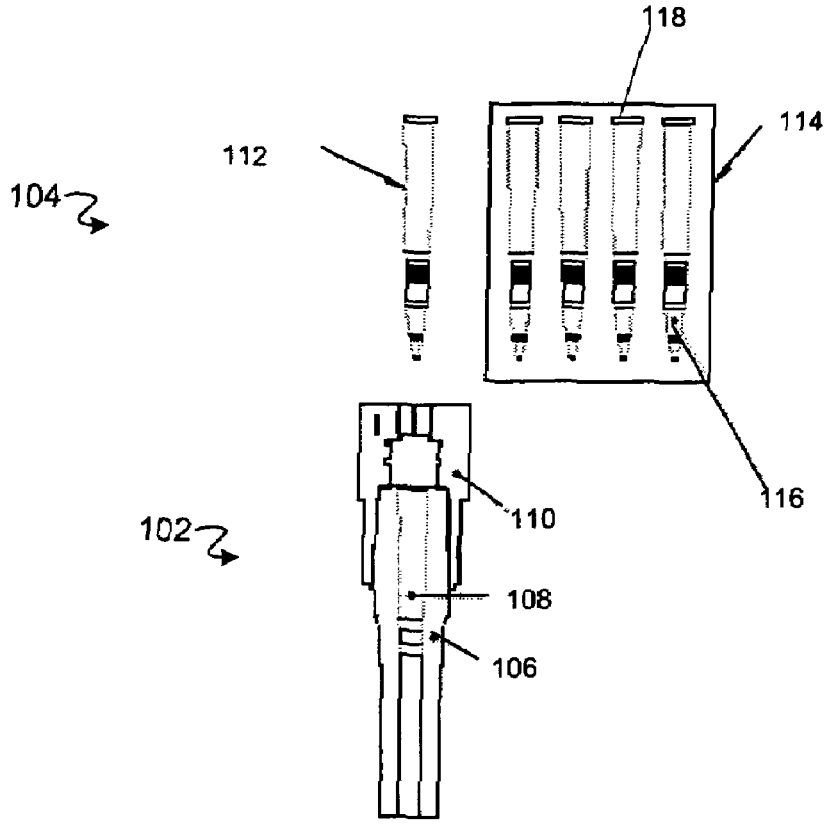
FIGS. 1A and 1B are illustrations of an ammunition loading process.
Figure 1B:
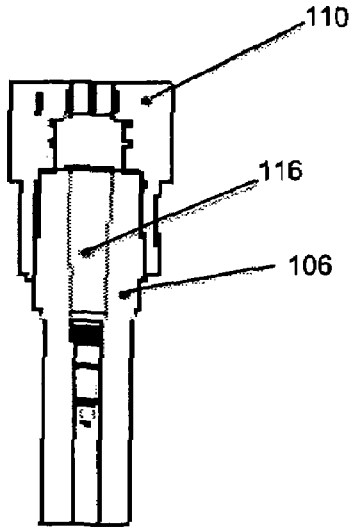

FIGS. 1A and 1B are illustrations of an ammunition loading process. In FIG. 1A, a portion of a gun 102 is shown as being loaded with ammunition 104. In the following description, the portion of the gun 102 may simply be referred to as the gun 102 for the sake of convenience; however, it should be understood that a given gun or other weapon may have many other portions that are not explicitly illustrated in FIGS. 1A and 1B, such as, for example, a triggering mechanism.

The gun 102 includes a barrel 106, in which a chamber 108 is positioned so as to receive a round of the ammunition 104. A breech 110 is positioned behind the chamber 108, and serves not only to seal the chamber 108 and ensure proper firing, but to assist in protecting personnel from injury related to instances such as, for example, a misfiring of the ammunition 104. That is, for example, the breech 110 may be opened as part of the ammunition loading process, and then closed once a round of the ammunition 104 is in place for loading into the chamber 108. Then, if a round of the ammunition 104 fires unexpectedly or has an unexpected reaction, the closed breech 110 will serve to assist in protecting personnel in the vicinity, as well as to prevent or minimize damage to the gun 102 or other equipment in the area.

In FIG. 1A, then, a round 112 is sequentially loaded from a magazine 114 for loading into the chamber 108. In this way, rounds of the ammunition 104 may be rapidly loaded into the gun 102, and, in particular, may be loaded in a largely or completely automatic manner, subject to the oversight and control of an associated gun crew. Each round of the ammunition 104 may then be fired, again subject to the control and oversight of the associated gun crew.

As just referenced, in some implementations, certain ones of the processes for loading and firing the ammunition 104 may be more or less automated. For example, each round of the ammunition 104 may contain electronic firing or triggering components, not explicitly shown in FIGS. 1A and 1B.

Such components may send, for example, an electronic signal to a firing system of the gun 102, such that each round of the ammunition 104 may be fired potentially as soon as that round is loaded and ready. As a result, for example, if the gun 102 represents a 57 mm gun, then the gun 102 may be fully automatic and unmanned (in the gun mount itself) with respect to the ammunition loading and firing procedure(s) beyond the initial loading of rounds into the magazines 114. Again, however, such loading and firing procedures may be initiated, controlled, modified, or halted, as needed, by the associated gun crew.

In FIG. 1A, the last round of ammunition in the magazine 114 is a data-collecting round 116. As described in more detail below, the data-collecting round 116 may include a data acquisition system that is encapsulated within the round 116 and connected to a plurality of thermocouples or other sensors that also are disposed within or throughout the round 116.

When all of the preceding rounds of ammunition from the magazine 114 have been loaded and fired, and, in particular, after the immediately-preceding round 118 has been loaded and fired, the data-collecting round 116 may be immediately rammed into the barrel 106, as illustrated in FIG. 1B. The data-collecting round 116 generally contains components that are designed not to damage the gun 102 or the data-collecting round 116 when the gun 102 is attempting to 'fire' the data-collecting round 116. The data-collecting round 116 is generally designed to imitate the exterior dimensions and physical features, as well as overall weight of similar rounds, in order to force the gun to behave as if there is a live round chambered that is essentially (or, in some cases, exactly) like the immediately-preceding round 118. The data-collecting round 116 also may be designed to include inert components, so as to guard against any reaction taking place when loaded into the barrel 106. Materials that possess the same, or as close as possible, physical and thermal properties may be used to sufficiently simulate the heating characteristics of a live piece of ammunition with an inert data-collecting round 116.

More particularly, the data-collecting round 116 may specifically be designed not to contain any triggering components that may be contained within all of the other rounds of the ammunition 104 from the magazine 114 to prevent the gun 102 from firing. In other implementations, the data-collecting round 116 may contain components that affirmatively send out a signal that prevents firing of the gun 102 when the data-collecting round 116 is loaded.

As a result, the gun 102 experiences a stoppage in its firing procedure, and the data-collecting round 116 remains seated within the chamber 108. During the time that the data-collecting round 116 is readied, loaded, and/or seated, the thermocouples and/or other sensors within or on the data-collecting round 116 may be operable to sense data regarding the components of the data-collecting round 116, such as, for example, temperature data as well as timing information as to when the collected temperature data points occur.

Figure 2A:
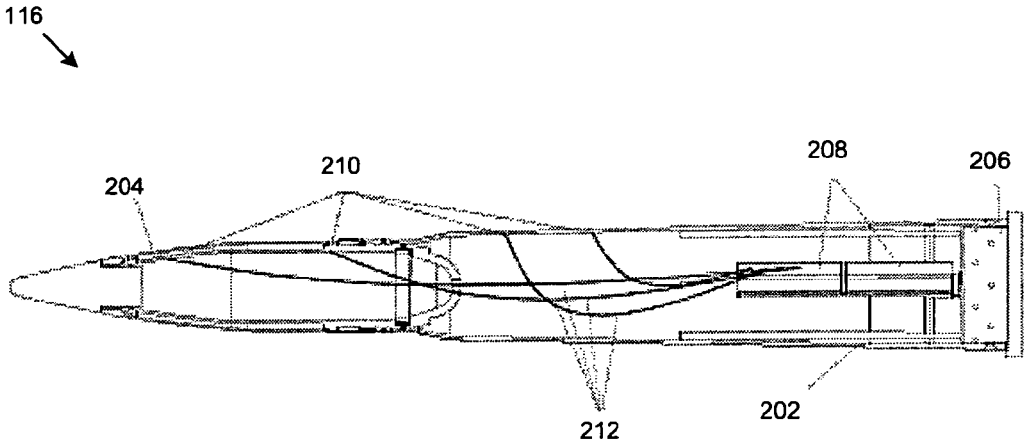
FIGS. 2A and 2B are diagrams of implementations of a data-collecting round of ammunition of FIGS. 1A and 1B.
Figure 2B:
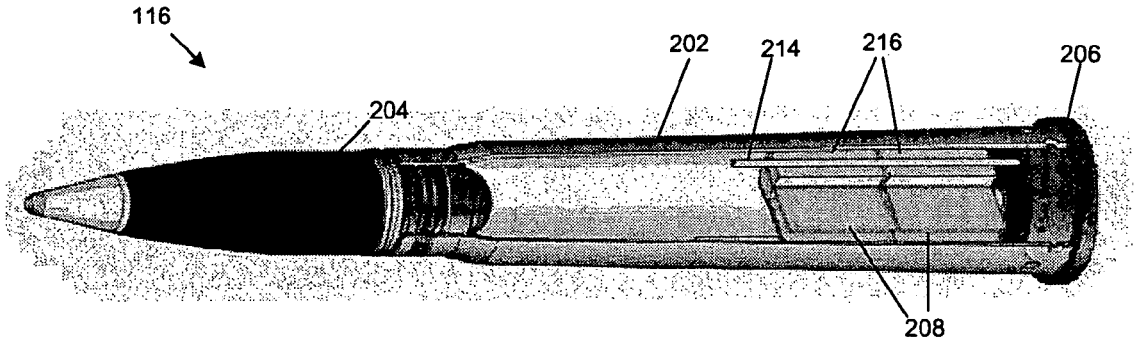

FIGS. 2A and 2B are diagrams of implementations of the data-collecting round 116 of FIGS. 1A and 1B. In particular, FIG. 2A is a line drawing of an interior of an implementation of the data-collecting round 116, while FIG. 2B is a cut-away view of an implementation of the data-collecting round 116.

In FIGS. 2A and 2B, the data-collecting round 116 includes a cartridge case 202 and a projectile body 204. A base 206 is attached to the aft end of the case 202 and the case 202 is secured (e.g., crimped) onto the aft end of the projectile body 204. A data acquisition system 208 is attached to the base 206, thereby disposed within an interior of the data-collecting round 116.

The data acquisition system 208 is typically connected to a plurality of thermocouple connections 210 by way of thermocouple wires 212. As referenced above, data sensed by the thermocouple connections 210 may be collected and stored within the data acquisition system 208.

In FIG. 2B, an example of a packaging of the data acquisition system 208 is provided in which a plurality of data loggers 208 are mounted to the base 206 by way of connecting rods 214 and associated packaging components 216. Characteristics and types of the data loggers 208, as well as additional or alternative packaging techniques therefore, are described in more detail below, and, in particular, examples are discussed with respect to FIGS. 3A and 3B.

As already described, then, the data-collecting round 116, placed as a final round of the magazine 114, may be cycled through an ammunition loading process of the gun 102. The data-collecting round 116 is loaded into the chamber 108 immediately after the preceding round 118 is fired. As a result, the data-collecting round 116 generally experiences essentially the operating environment that would be experienced by an actual live round loaded immediately after a firing of the preceding round 118.

Since, however, the data-collecting round 116 notably does not include any triggering mechanism, such as, for example, a mechanism for electro-magnetically transmitting a firing signal, the actual loading of the data-collecting round 116 into the chamber 108 does not cause a firing of the data-collecting round 116. Instead, the lack of an appropriate firing signal causes a stoppage of the gun 102 while the data-collecting round 116 is loaded within the chamber 108, so that the data acquisition system 208 may continually collect time and temperature data in situ within the chamber 108. The absence of live explosive or propellant also ensures that a firing of the data-collecting round 116 will not take place.

Once a safe time has passed or the desired duration of data collection has elapsed, the data-collecting round 116 may be removed from the gun 102. Then, the data acquisition system 208 within the data-collecting round 116 can be connected to a computer, for downloading of the collected data for subsequent analysis.

The collected and analyzed data may be useful for a variety of purposes, depending on, for example, the type of data collected or the reason for which the data was collected. For example, when the collected data relates to temperatures detected by the data-collecting round 116 during the processes described above, then the collected temperature data (and related time data) may be analyzed and used to develop safe hot gun misfire procedures.

Such hot gun misfire procedures generally refer to procedures that are put into place to be followed by personnel in charge of operating the gun 102, so as to avoid unexpected reactions from occurring in bore or uncharacteristic firings of the gun 102. In this context, the following terminology may be used, in which "cook-off" may be said to occur when components of the gun 102 reach a temperature high enough to cause sufficient heat input into a piece of ammunition to cause runaway self-heating to some form of explosive reaction in a loaded round of ammunition, and a "cold gun" condition may be said to exist when temperatures of the gun barrel 106 and a wall of the chamber 108 have not been raised by prolonged firing to a point where cook-off can occur. In contrast, a "hot gun" condition may be said to exist when a temperature of the gun barrel 106 and a wall of the chamber 108 have been raised through prolonged firing to the point where a cook-off may occur.

Further, a "hang-fire" may be said to occur when there is a delay beyond the normal ignition time after the initiating action is taken; for example, if the gun 102 were to fire some excessively-long time after a triggering event such as a turning of a firing key. Different than a hang-fire is a misfire, in which the loaded round of the ammunition 104 does not fire at all (in which case a determination must be made as to when and how to clear the gun 102 of the misfired round), and may explode or have an unexpected reaction within the chamber 108.

Using the above terminology, then, it may be seen that occurrence of cook-off and/or misfire when the breech 110 is closed may result in an essentially normal firing of the gun 102. It may also be seen that occurrence of cook-off and/or misfire when the breech 110 is closed may alternately result in a reaction uncharacteristic of normal firing of the gun 102, and may result in permanent damage to the gun 102 or a threat to personnel. Cook-off with the breech 110 open, however, may result in injuries and/or damage to the gun 102, surrounding equipment, and personnel.

As a result, the above-referenced hot gun misfire procedures must be used, for example, to inform personnel as to how long to wait after a misfire or possible hang-fire has occurred, before opening the breech 110 and removing the misfired piece of ammunition. A safe clearing time predictor may be used that relies on a sufficiently lengthy time essentially to guarantee safety.

During combat or certain other maneuvers, it may be necessary to minimize the clearing time as much as possible without endangering the safety of the operators of the gun 102, so as to facilitate continued and rapid firing of the gun 102. In such cases, collection and analysis of time and temperature data by the data-collecting round 116 may be used to determine, for example, when cook-off is likely to occur or not occur, and how long to wait after a misfire before a given level of safety is reached with respect to opening the breech 110 and removing the piece of ammunition.

In developing such information and procedures, the data-collecting round 116 may be advantageous in that the relevant temperature/time histories of the data-collecting round 116 are gathered nearly instantaneously after a firing of the preceding round of (live) ammunition, so that, for example, all of the breech components may still be in their fire/misfire positions, and a minimal time will have passed in which heat dissipation may occur. Such instantaneous data-gathering results in realistic representations of the environment within the gun 102, and is made possible at least in part by the fact that the data-collecting round 116 may be generally loaded into the gun system the exact same way as a normal round would be loaded, and takes no extra time to load than a non-instrumented all-up-round.

More particularly, as data acquisition may begin immediately following a live fire event, which may generally be the time period most important in determining the ammunition heating characteristics with respect to cook-off, the described implementations eliminate a time required to wait for the gun mount to be deemed safe for entry (e.g., in the instance of a fully enclosed gun mount) before instrumentation may otherwise be inserted into the gun barrel, hence reducing or eliminating any loss of data immediately after cease fire.

Notably, it should be understood that the gun 102 may respond to the stoppage caused by the data-collecting round 116 in a manner essentially similar to what would occur in case of an actual misfire. That is, for example, the data-collecting round 116 may experience a build-up of heat as the data-collecting round 116 sits within the gun 102. In the case of an actual misfire or hang-fire of live ammunition, such a heat build-up may lead to an eventual firing or other uncharacteristic reaction of the live ammunition, so that actual knowledge of the temperature variations may be useful in developing safe misfire procedures for clearing live ammunition from the gun 102, when necessary.

Further, by allowing the data-collecting round 116 to operate independently once placed in the gun system being evaluated, the safety of operating personnel may be increased, since, for example, user involvement is minimal while the data is collected. In fact, a single user may be able to operate the described implementations, including setup, loading the data-collecting round 116, and downloading and processing the acquired data.

In other words, the self-contained nature of the data-collecting round 116 allows the data-collecting round 116 to cycle completely through a gun handling system and load into a gun barrel with minimal direction or input from the operating personnel, and without interfering with the gun system and/or an ammunition loading mechanism of the gun system. As a result, the described implementations for non-intrusive temperature instrumentation for data acquisition in ammunition allows for the collection of valuable ammunition heating data in an area that may be physically hazardous and without requiring modification of or instrumentation to the generally more expensive gun barrel 106 itself.

Additionally, the dispersed nature of the thermocouple connectors 210 within or on the data-collecting round 116 allows for a variety of temperature data points to be collected by the data acquisition system 208. Such variety in the collected data may allow for improved modeling of the temperature response of the data-collecting round 116.

Figure 3A:
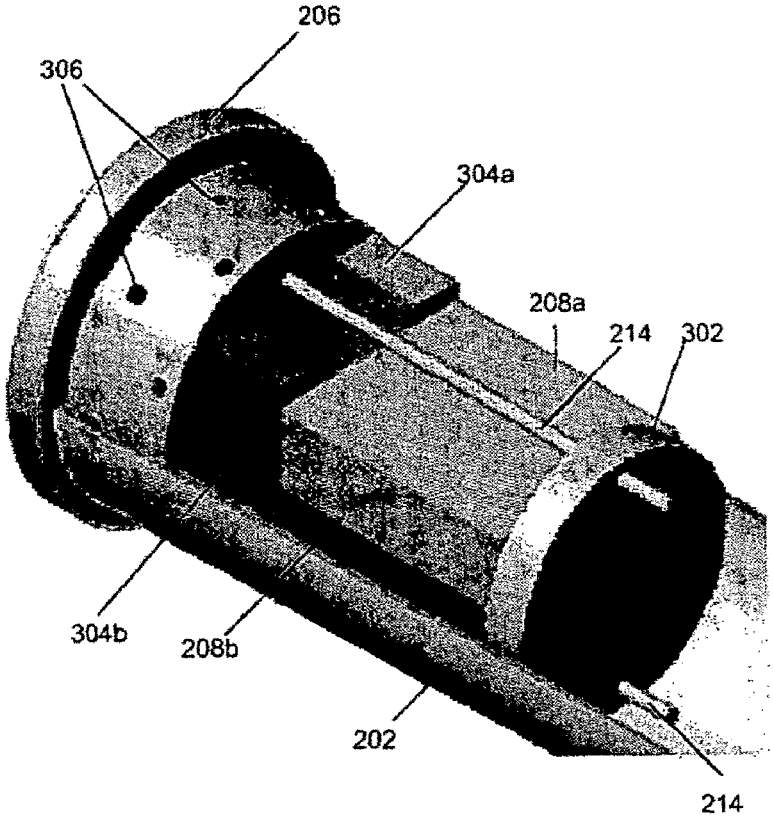
FIGS. 3A and 3B are illustrations of packaging configurations of a data acquisition system of FIGS. 2A and 2B.
Figure 3B:
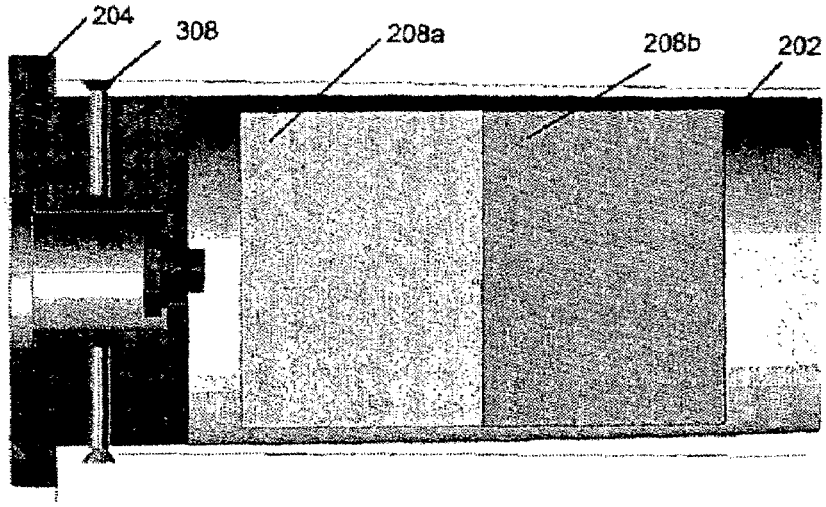

FIGS. 3A and 3B are illustrations of packaging configurations of the data acquisition system 208 of FIGS. 2A and 2B. Of course, the illustrated packaging configurations are merely provided as examples, and other configurations also may be used, for example, to accommodate other pieces of ammunition or other types of data acquisition systems.

In FIG. 3A, two data loggers 208*a* and 208*b* are mounted on top of one another within the case 202. Further in FIG. 3A, a securing plate 302 is maintained in contact with the data loggers 208*a* and 208*b*, in conjunction with the connecting rods 214, so as to exert pressure on the data loggers 208*a* and 208*b* against the base 206, and thereby provide stability to the data loggers 208*a* and 208*b* within the case 202.

Batteries 304*a* and 304*b* are connected to the data loggers 208*a* and 208*b*, respectively, so as to provide power thereto. As shown, the batteries 304*a* and 304*b* also are maintained in a stable manner within the case 202 by way of the connecting rods 214 and the securing plate 302.

In FIG. 3B, the data loggers 208*a* and 208*b* are mounted in a parallel configuration, with the batteries 304*a* and 304*b* not being visible in the cut-away view shown. In FIGS. 3A and 3B, the presence of the two data loggers 208*a* and 208*b* allows for, for example, redundancy in case of failure of either one. Additionally, or alternatively, the presence of the multiple data loggers 208*a* and 208*b* allows for the collection of a plurality of different types of data. For example, the data logger(s) 208 may be operable to measure parameters such as humidity, voltage, pressure, shock, velocity, acceleration, an on/off condition of a particular component, or many other events or states that may be present in the described or other environments. And lastly, or alternatively, the presence of multiple data loggers 208*a* and 208*b* allows for the collection of additional channels of data of the same type, where two data loggers 208*a* and 208*b* may be used to collect a twice the number of channels of data instead of the number provided from a single data logger 208.

In some implementations, the data logger(s) 208 refer generally to relatively small devices equipped with a microprocessor, some type of data storage, and sensor inputs for receiving data from the thermocouple connectors 210 (and/or other sensors). As referenced, collected data may be easily viewed by downloading the data to a personal computer, laptop computer, hand-held computer, or other type of computing device, using specifically-designed software, and/or software that is generally applicable to a type of the data logger 208 that is used. In some implementations, the data loggers 208*a* and 208*b* may be off-the-shelf components, and may be connected to the computing device by way of a standard port on the computing device, such as, for example, a serial port or an RS-232 COM port.

Similarly, the data logger 208 may be initialized and set-up by way of the same, or similar, software. For example, the data logger 208 may be connected to an appropriate computing device to select desired types of data to be collected, such as one or more of those just referenced, as well as to define certain logging parameters that may include, for example, a data sampling interval of the data logger 208, or a start time/signal for the data logger 208.

As described, the data logger 208 collects data measurements for storage within the associated data storage, as well as associated time and date information. Once downloaded, the data may be illustrated in graphical form over time, or in tabular form, or may be viewed within a spreadsheet or other data processing application.

Various types of data loggers may be used. For example, data loggers may be used that have a single data channel, or many dozens or hundreds of input channels. Depending on needs, more expensive data loggers may be used that have high sampling rates and large amounts of internal memory, or less expensive versions may be used that have lower sampling rates and less internal memory.

In some implementations, the data logger 208 may include an 8-channel data logger that may store up to 15,000 or more temperature (or other) data points per channel. The internal memory of the data logger 208 may include, for example, non-volatile, solid-state memory, so that measurements are not lost in the event of loss of battery power.

Figure 4:
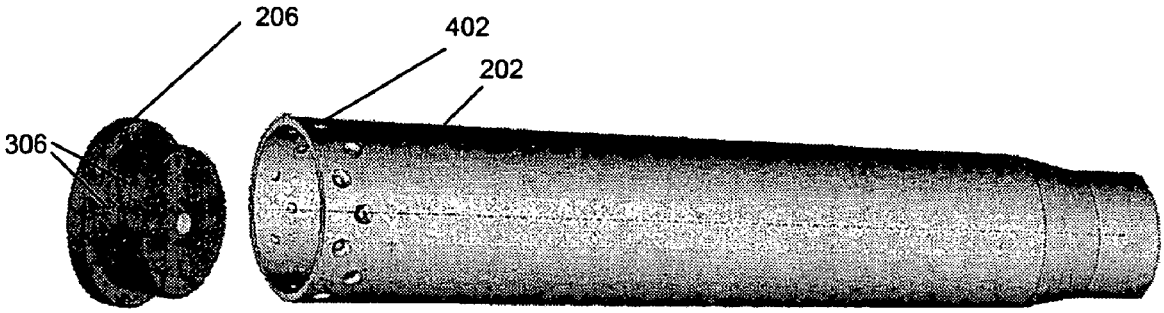
FIG. 4 is an illustration of modifications to a cartridge case made to accommodate coupling techniques of FIGS. 3A and 3B.

Finally in FIGS. 3A and 3B, holes 306 within the base 206 may be used to mount the base 206 to the case 202, using bolts 308. FIG. 4 is an illustration of modifications to the case 202 made to accommodate the mounting techniques of FIGS. 3A and 3B. In particular, FIG. 4 illustrates the use of holes 402 within the case 202, through which the bolts 308 or other connectors may be connected to the holes 306 of the base 206.

Figure 5A:
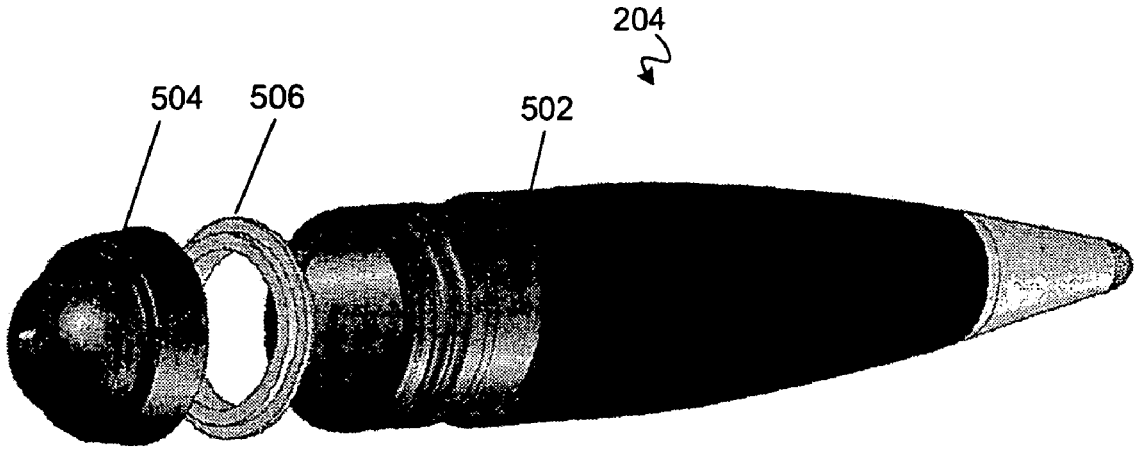
FIGS. 5A and 5B illustrate modifications that may be made to a projectile body of the data-collecting round of FIGS. 1A-4 to accommodate instrumentation.
Figure 5B:
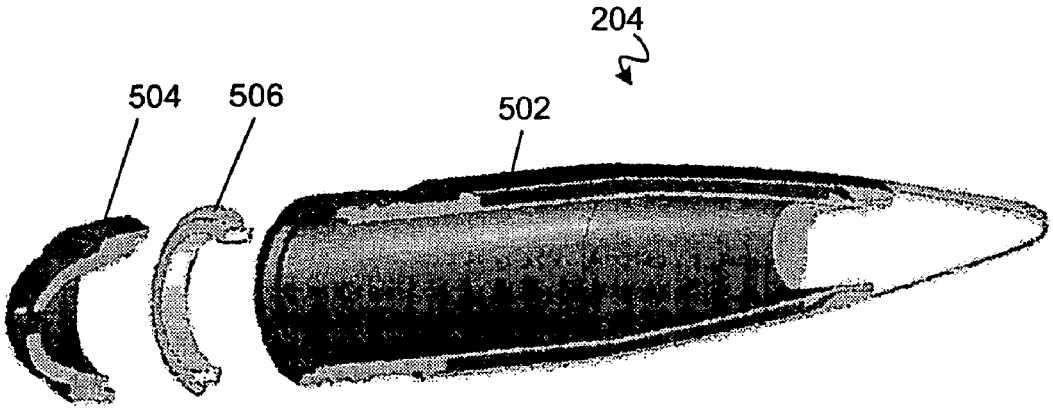

FIGS. 5A and 5B illustrate modifications that may made to the body 204 of the data-collecting round 116 of FIGS. 1A-4 to accommodate instrumentation. In FIG. 5A, the forward end 502 of the body 204 is connected to an aft end 504 by way of a bushing portion 506 with the same or similar material properties. FIG. 5B is a cut-away view of the components 502, 504, and 506 of FIG. 5A.

The forward end 502 and aft end 504 are connected (e.g. welded) to the bushing portion 506 and the case 202 is secured (e.g. crimped) onto the assembled body 204 to form the entire data-collecting round 116. Of course, many different mounting techniques may be used for the cartridge case, the data acquisition system(s) (e.g., the data logger(s) 208), and related components.

Figure 6:
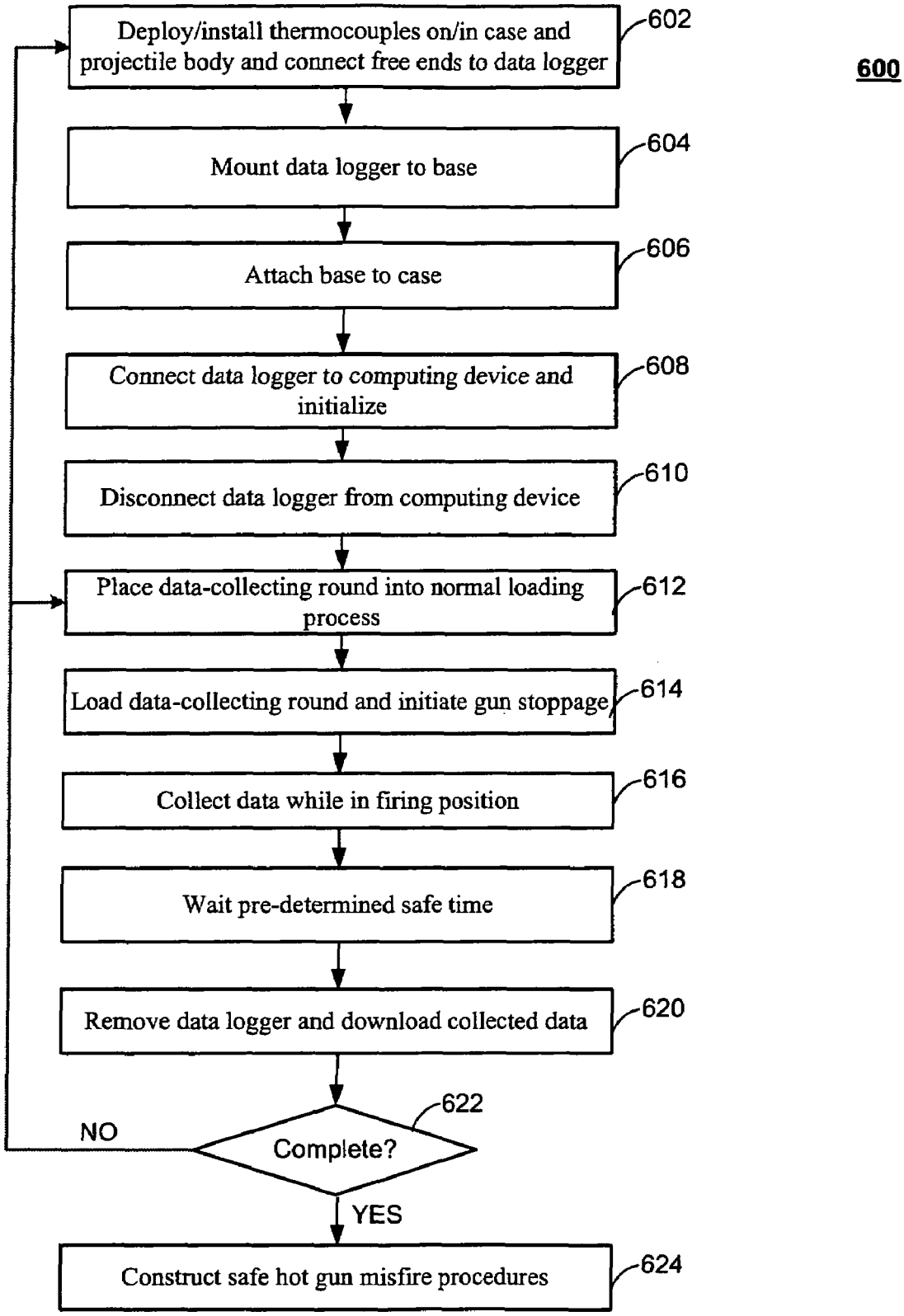
FIG. 6 is a flowchart illustrating a process for using the data-collecting round of FIGS. 1A-5.

FIG. 6 is a flowchart 600 illustrating a process for using the data-collecting round 116 of FIGS. 1A-5. Although the process is illustrated sequentially, it should be understood that portions of the process may be performed in sequences not specifically illustrated.

The thermocouple connectors 210 or other sensing devices may be distributed and deployed within or on a body 204 and cartridge case 202 of the data-collecting round 116, and connected to the data logger 208, as well (602). Then, the data logger 208 is mounted to the base 206 (604). The base 206, with the mounted data logger 208, may then be attached to the cartridge case 202 (606), so as to dispose the data logger 208 within and the thermocouple connectors 210 within or on the data-collecting round 116.

In FIG. 6, the data logger 208 or other data acquisition system is connected to a computing system for initialization, calibration, and/or determination of other relevant parameters, including the amount, extent, or type of data to be measured (608). Then, the data logger 208 is disconnected from the computing device (610).

In this way, the data-collecting round 116 may be placed into a normal loading process of the gun 102 (612). For example, the data-collecting round 116 may be placed as the final round within the magazine 114, so as to be the last round loaded into the chamber 108.

Once loaded into the chamber 108, the data collecting 116 round is operable. Then, stoppage of the gun 102 is initiated by failure to fire the data collecting round 116 (614), so as to avoid any attempt to fire the data-collecting round 116. With the stoppage in effect, the data logger 208 may begin to collect temperature and/or other data (616).

Then, after some time has passed to allow safe access to the interior of the gun 102 or sufficient time has elapsed to collect the desired data (618), the data-collecting round 116 may be removed from the chamber 108. In this way, the data logger 208 may be connected to a computer system, and the collected data may be downloaded to the original computing device (620).

If sufficient data has not been collected for a desired purpose (622), then the process may continue either with replacing the data-collecting round 116 back into a second loading process (612), or by re-starting the entire process (602). For example, it may be desirable to determine temperature characteristics of the data-collecting round 116 after different numbers of rounds of the ammunition 104 have been fired from the gun 102. For example, in a first trial, the data-collecting round 116 may be the $n^{th}$ of n rounds, and may be the $m^{th}$ of m rounds in a second trial, and may be the $p^{th}$ of p rounds in a third trial. In this way, heating characteristics at different points of firings of the magazine(s) 114 may be determined.

The collected data may then be used, for example, to determine procedures for clearing live ammunition from hot gun barrels (624), or to determine other information or procedures that may be useful in operating the gun 102. In one example, live fire testing is coupled with thermal finite element method (FEM) modeling to evaluate a range of possible scenarios that could lead to a catastrophic result in a hot gun cook-off situation. This testing may use data from a range of hot gun tests, which include multiple-round firing tests to obtain the ammunition heating characteristics, as just referenced.

As described above, a piece of ammunition, such as, for example, a projectile, a propelling charge, or an all-up-round/cartridge, may be instrumented with thermocouples or other sensors to enable the collection of the time/temperature histories (or other types of data) of the specific test item. Coupled with an on-board/self-contained data acquisition system, the test article can be setup to collect the data for the duration of the test, with minimal user setup. Once the test article is initiated, it may require no additional user manipulation until the completion of the test. Following a test event, the test article may be connected to a computer to allow the user to download the required data.

In the case of temperature/time histories, data may be collected immediately following a live firing event. Such instantaneous data collection may be especially useful in determining the transient ammunition heating characteristics, as well as, for example, in assisting in the validation of thermal FEM models. Once such models are validated, the models may be used in the development of safe hot gun misfire procedures.

Such hot gun misfire procedures and/or validated thermal FEM models, as well as other procedures, may be developed for, for example, the 57-mm MK 110 MOD 0 gun, or the 5-in./54 caliber MK 45 MOD 2 gun mount. However, similar concepts may be applicable with respect to a variety of other gun systems, within the Navy, Army, Air Force and other national defense programs (that require similar safety procedures or require ammunition heating data for other purposes), all of which may benefit from the described abilities. Such abilities also are available to expand the described implementations to collect a variety of other types of data in ammunition, or in other standalone hardware. For example, private companies or organizations that design, manufacture, and test gun systems may benefit. Also, other types of data may be measured, such as, for example, acceleration, in order to help gather information on sensitive electronics in fuzes or guidance packages.

The described data acquisition systems include standalone units with internal data collection. However, if, for example, no electronically-triggered firing mechanisms for live ammunition are present in a particular environment (that is, if a HERO (hazards of electromagnetic radiation on ordnance) sensitive environment is not an issue), then data collected by the data acquisition systems may be transmitted wirelessly over, for example, a radio-frequency signal.

Accordingly, data collection techniques are described in which a data-collecting test round is chambered in a hot gun barrel, and data may be collected for defining hazards posed by a hot gun to its ammunition in the event of a misfire or foul bore. The collected data may be used to validate thermal FEM models as a basis for hot gun misfire procedures.

Described implementations provide the possibility for an unmanned, safe, and cost-effective way to gather temperature data in an environment that may include the presence of live ammunition or ammunition that may or may not be susceptible to electromagnetic effects. Further, a practical, safe, inexpensive, and efficient manner of gathering data is enabled for, for example, determining the ammunition heating characteristics of a gun system.

Although such implementations are described for collecting temperature data for testing of hot gun hazards, the same, similar, or other implementations also may be expanded for usage in other gun systems that may benefit from stand-alone data collection of a variety of types of data with added instrumentation, minimal user manipulation, and ensured safety around ordnance.

Further, depending on data requirements, described implementations for standalone systems may be beneficial for use in any environment that is difficult or hazardous to access. Moreover, a high portability is provided, thereby facilitating applications on numerous systems, without being permanently fixed to any one of the systems.

While certain features of the described implementations have been illustrated as described herein, many modifications, substitutions, changes and equivalents will now occur to those skilled in the art. It is, therefore, to be understood that the appended claims are intended to cover all such modifications and changes as fall within the true spirit of the embodiments of the invention.

What is claimed is:

1. An apparatus for collecting data in a gun-launch weapons system, comprising:

an inert simulation munition round conforming to disposal within a firing position of the weapons system;

a data acquisition system disposed within said round, said data acquisition system having a storage memory; and a plurality of sensors disposed in association with said round and in communication with said data acquisition system to provide measurement data for components of said round while said round is within said firing position, said data recorded on said storage memory.

2. The apparatus of claim 1, wherein said round inhibits fixing of the weapons system while said round is within said firing position.

3. The apparatus of claim 1, further comprising a loading mechanism for loading said round into said firing position as part of a loading process for loading live rounds of ammunition into said firing position for firing.

4. The apparatus of claim 1, wherein includes round comprises a projectile body and a cartridge case, said case including a base attached to an aft end of the case, and wherein said data acquisition system attaches to said base.

5. The apparatus of claim 4, further comprising a power supply contained within said case and operable to power data collection and storage of said data acquisition system.

6. The apparatus of claim 1, further comprising a data logger, and wherein said plurality of sensors include a plurality of thermocouples in communication with said data logger to provide temperature data while said round is disposed in said firing position.

7. An ammunition round for collecting data in a gun-launcher that launches an all-up-round, said round comprising:

a projectile body;

a cartridge case having fore and aft ends, said case being crimped at said fore end to said body, said case having a base at said aft end;

a plurality of sensors for acquiring measurement data from the round and the gun-launcher;

a data logger for receiving said measurement data from said plurality of sensors, said data logger disposable on said base;

a memory for storing said measurement data received from said data logger; and a power supply for providing electrical power to said data logger, wherein the ammunition round characterizes mass properties of the all-up-round, and wherein the ammunition round simulates the all-up round as an inert simulation round.

8. The apparatus of claim 7 wherein the ammunition round inhibits transmission of a firing signal.

9. The apparatus of claim 7 wherein at least one sensor of said plurality of sensors is a thermocouple.

10. The apparatus of claim 7 wherein said data acquisition system includes an interface port connectable to a computer for transferring recorded measurement data thereto.

* * * * *